US006336239B1

(12) United States Patent
Cooper

(10) Patent No.: US 6,336,239 B1
(45) Date of Patent: Jan. 8, 2002

(54) BIN WASHER

(76) Inventor: Norman William Cooper, Lot 55, Southern Highway, York, Western Australia 6302 (AU)

( * ) Notice: Subject to any disclaimer, the term of this patent is extended or adjusted under 35 U.S.C. 154(b) by 0 days.

(21) Appl. No.: 09/487,127

(22) Filed: Jan. 19, 2000

Related U.S. Application Data

(63) Continuation of application No. PCT/AU98/00516, filed on Jul. 3, 1998.

(30) Foreign Application Priority Data

Jul. 16, 1997 (AU) ..... PO 7976

(51) Int. Cl.[7] ..... B08B 1/04; B08B 9/087; B08B 9/36

(52) U.S. Cl. ..... 15/56; 15/71; 134/104.2; 134/168 R

(58) Field of Search ..... 15/56, 57, 58, 15/70, 71; 134/62, 104.2, 111, 167 R, 168 R

(56) References Cited

U.S. PATENT DOCUMENTS

| | | | | | |
|---|---|---|---|---|---|
| 2,764,171 | A | * | 9/1956 | Nolte | 134/168 R |
| 3,203,437 | A | * | 8/1965 | Faust | 15/71 X |
| 3,291,144 | A | * | 12/1966 | Diamond | 134/111 X |
| 3,324,866 | A | * | 6/1967 | Davis | 134/62 X |
| 3,604,038 | A | * | 9/1971 | Di llio | 15/56 |
| 4,242,311 | A | * | 12/1980 | Middaugh | 134/167 R |
| 4,485,513 | A | * | 12/1984 | Eskelinen | 15/56 |
| 5,964,229 | A | * | 10/1999 | Brendel | 134/62 |

FOREIGN PATENT DOCUMENTS

| | | | | |
|---|---|---|---|---|
| DE | 1924562 | * | 11/1970 | 134/168 R |
| DE | 2536774 | * | 3/1977 | 134/104.2 |
| FR | 2547748 | * | 12/1984 | |
| FR | 2610306 | * | 8/1988 | 134/167 R |
| FR | 2645775 | * | 10/1990 | 134/167 R |
| GB | 2301022 | * | 11/1996 | |
| SU | 1567304 | * | 5/1990 | 15/56 |

* cited by examiner

*Primary Examiner*—Mark Spisich
(74) *Attorney, Agent, or Firm*—Perkins, Smith & Cohen, LLP; Stephen Y. Chow

(57) ABSTRACT

An apparatus for cleaning a bin includes an elongate rotatable stem locatable within the bin, the stem provided with a number of nozzles for spraying cleaning fluid onto the inside of the bin. The stem also includes an array of brushes along a portion of its length for contacting the inside surface of the bin. A laterally extending arm is provided at one end of the stem and carries a number of brushes to contact the inside of bottom wall of the bin. A hydraulic motor is located at an opposite end of the stem for providing motive force to cause the stem to rotate about an axis coincident with its length. In use, the bin is held in an inverted state over the stem. As the stem rotates cleaning fluid is sprayed through nozzles and the brushes scrub the inside surface of the bin to clean the bin.

3 Claims, 3 Drawing Sheets

BIN WASHER

CROSS REFERENCE TO RELATED APPLICATIONS

This application is a continuation of International Application No. PCT/AU98/00516, filed Jul. 3, 1998.

FILED OF THE INVENTION

This invention relates to an apparatus for washing bins and particularly to a bin washer that washes domestic bins of the wheelie bin type.

BACKGROUND OF THE INVENTION

There has always been a problem with effectively washing rubbish bins in general. This is due to their size and elongate shape which hampers free and full access to the interior of the bin during cleaning. Another problem is draining of the cleaning fluid. Often this will involve turning the bin onto its side or inverting the bin. This increases the time required to effectively clean a bin and consequently where it is necessary to clean a large number of bins, the process becomes increasingly more difficult.

One method of cleaning bins involves using a truck mounted system which picks up the bin and holds it in an inverted or inclined position. An operator then uses a hand held spray gun to spray cleaning fluid under pressure into the bin. The cleaning fluid self drains from the bin onto a screen so as to remove any unwanted solids. The cleaning liquid is stored in a holding container and is then recycled via a pump back to the spray gun. This method is a vast improvement over the manual methods of cleaning. However it is considered that this method is still not overly quick and may have difficulty in removing grime caked on the bin.

It is therefore an object of this invention to provide an alternate apparatus for cleaning bins with increased efficiency.

SUMMARY OF THE INVENTION

According to the present invention there is provided a mobile cleaning system for a bin including:

a self propelled vehicle;

a bin manipulation arm for gripping, lifting and inverting a bin;

an apparatus for cleaning a bin supported on said vehicle, the apparatus comprising a single elongate rotatable stem locatable at a fixed spatial position within a bin when the bin is held in an inverted state by said bin manipulation arm, said stem adapted to transfer cleaning liquid to the inside of the bin and arranged to support a brush means contacting the inside of the bottom and side walls of said bin in a manner so that in one complete revolution of the stern substantially the whole of the inside of the bottom and side are contacted by the brush means;

stationary spray means for spraying cleaning fluid onto an inside surface of a lid of said bin when the bin is in the inverted state;

a catchment tank supported an said vehicle in which said stem and stationary spray means arc located for collecting said cleaning liquid; and, whereby, in use, the bin manipulation arm grips. lifts and inverts the bin and holds said bin over said stem and the catchmont tank and said stem is rotated and cleaning fluid supplied to said stem so that refuse is removed from the inside of the bin by a combination of the cleaning fluid and rotating brush means, and wherein said cleaning fluid and debris washed from said bin fall into said catchment tank.

Preferably said vehicle includes a hydraulic motor at a lower end of said stem for applying torque to rotate the stem, wherein said hydraulic motor is driven by said cleaning fluid.

Preferably said cleaning fluid is water delivered to said stem at a pressure in the range of 70–200 kpa and a temperature between 80–110° C.

According to another aspect of the present invention there is provided a mobile cleaning system for a bin including:

a vehicle;

an apparatus for cleaning a bin in accordance with the first aspect of the present invention;

bin manipulation arm for gripping, lifting and inverting a bin; and, catchment tank through which the stem of the apparatus extends, whereby, in use, the bin manipulating arm grips, lifts and inverts the bin and holds the bin over both the stem and the catchment tank so that cleaning fluid and debris washed from the bin fall into the catchment tank.

Preferably the catchment tank includes filter means for filtering the cleaning fluid transferred by the stem and debris from the bin, and means downstream of the filter means to allow filtrate to be recycled as cleaning fluid for washing a subsequent bin.

The objects set forth above as well as further and other objects and advantages of the present invention are achieved by the embodiments of the invention described hereinbelow.

For a better understanding of the present invention, together with other and further objects thereof, reference is made to the accompanying drawings and detailed description and its scope will be pointed out in the appended claims.

BRIEF DESCRIPTION OF THE DRAWINGS

Embodiments of the present invention will now be described by way of example only with reference to the accompanying drawings in which.

DETAILED DESCRIPTION OF THE PREFERRED EMBODIMENTS

Figure 1:
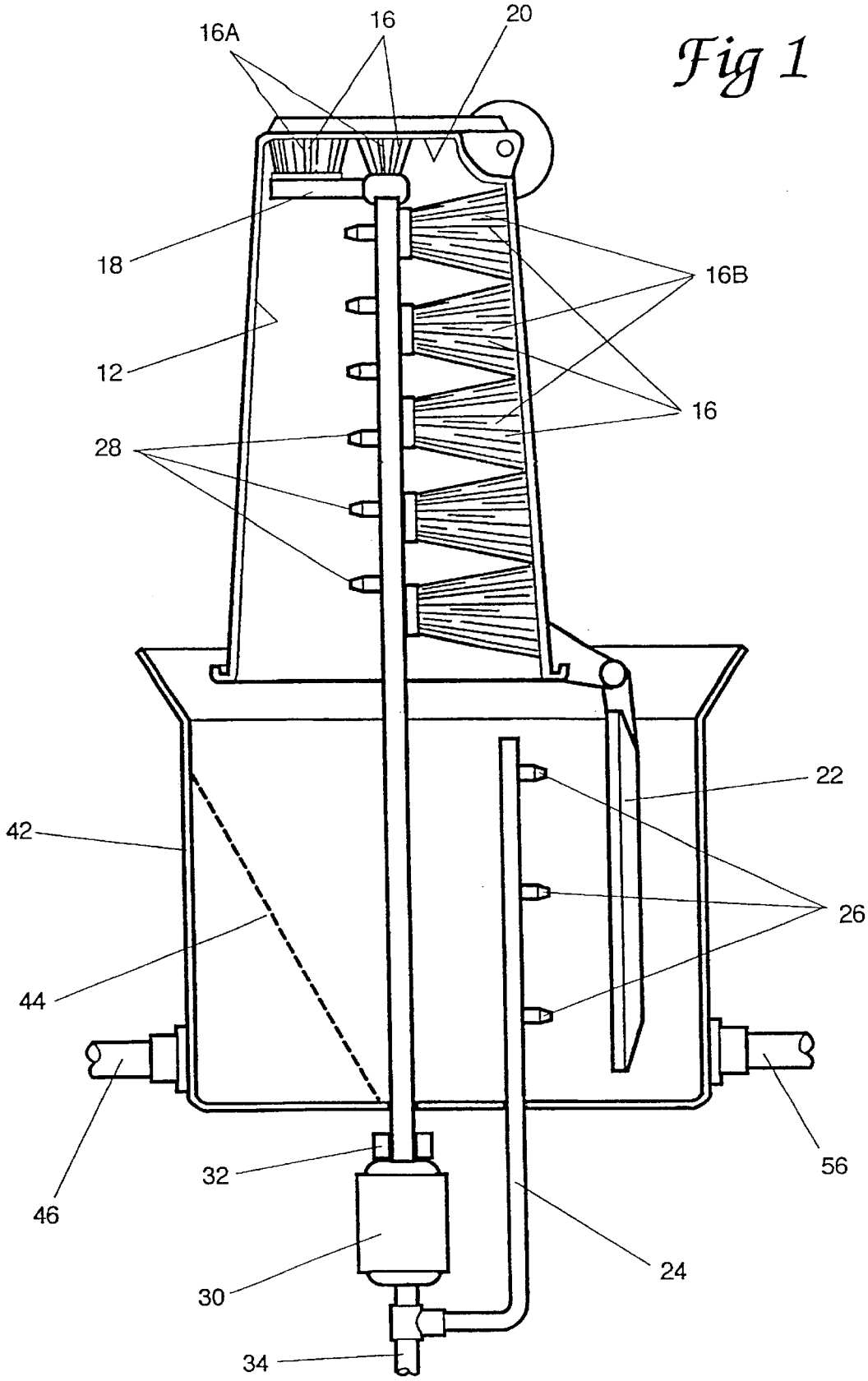
FIG. 1 is a section view of an apparatus for a bin.

Referring to FIG. 1, it ran be seen that an apparatus 10 for cleaning a bin 12 includes an elongate rotatable stem 14 that is locatable within the bin 12, the stem 14 adapted to transfer cleaning liquid to the inside of the bin 12 and arranged to support brush means 16 for contacting the inside of the bin 12 whereby, in use, refuse can be removed from the inside of the bin 12 by the combination of the cleaning fluid and the rotating brush means 16.

The stem 14 includes at one end a laterally extending arm 18. The brush means 16 includes two brushes 16A that are attached to the arm 18 and positioned so that when the bin 12 is supported in an inverted stated over the stern 14 the brushes 16A contact the inside of a bottom wall 20 of the bin 12.

The brush means 16 also includes a series of further brushes 16B attached along a length of the stem 14 substantially equal to the depth of the bin 12 starting from a point adjacent the arm 18. In this way, when the stem 14 rotates the brushes 16A and 16B are able to contact the entire inside surface of the bin 12 to the exclusion of the bin's lid 22. Cleaning of the inside surface of the lid 22 is achieved by the use of stationary spray means in the form of a spray bar 24 which is in fluid communication with a supply of the cleaning fluid transferred by stem 14. The spray bar 24 includes a plurality of nozzles 26 which direct a spray of the cleaning fluid onto the inside surface of the lid 22.

A number of further nozzles 28 are provided along the length of the stem 14 and the. arm 18 to spray cleaning fluid onto the inside surface of the bin 12.

Motive force to rotate the stem 14 about its length is provided by a hydraulic motor 30 located at an end of the stem 14 opposite the arm 18. Advantageously, though not essentially, the hydraulic motor 30 is driven by the cleaning fluid used for cleaning the inside of the bin 12. A rotary seal 32 is provided about the circumference of the stem 14 at the end adjacent the motor 30 to prevent loss of cleaning fluid. The cleaning fluid is supplied via a supply conduit 34 which feeds into the motor 30, stem 14 and the spray bar 24.

As is apparent from FIG. 1, when the bin 12 is supported in an inverted condition with the stem 14 located inside the bin 12, and cleaning fluid is supplied via conduit 34 the cleaning fluid drives the motor 30 to cause the stem 14 to rotate. As the stem 14 rotates the cleaning fluid is also sprayed or ejected from the nozzles 28 and the brushes 16A and 16B scrub the inside surface of the bin 12. Cleaning fluid is also sprayed via nozzles 26 onto the inside surface of the lid 22. The ejected or sprayed cleaning fluid together with debris scrubbed from the bin 12 falls from the bin 12 by action of gravity.

In order to enhance the cleaning action it is preferred that the cleaning fluid be at an elevated pressure and temperature. More particularly, the cleaning fluid may be supplied at a pressure in the order of 150 kpa gauge pressure. This results in the cleaning fluid being sprayed with considerable force onto the inside surface of the bin 12 so that the pressure of the liquid itself can dislodge debris on the inside of the bin. Further, by having the fluid temperature elevated say at between 80° to 110° celcius harmful bacteria may be killed without the use of chemical disinfectants and germicides. Ideally the cleaning fluid is water and it is provided at the elevated temperature and pressure by use of the WAIPUNA™ system. This system provides a supply of water at elevated temperature and pressure.

Figure 2:
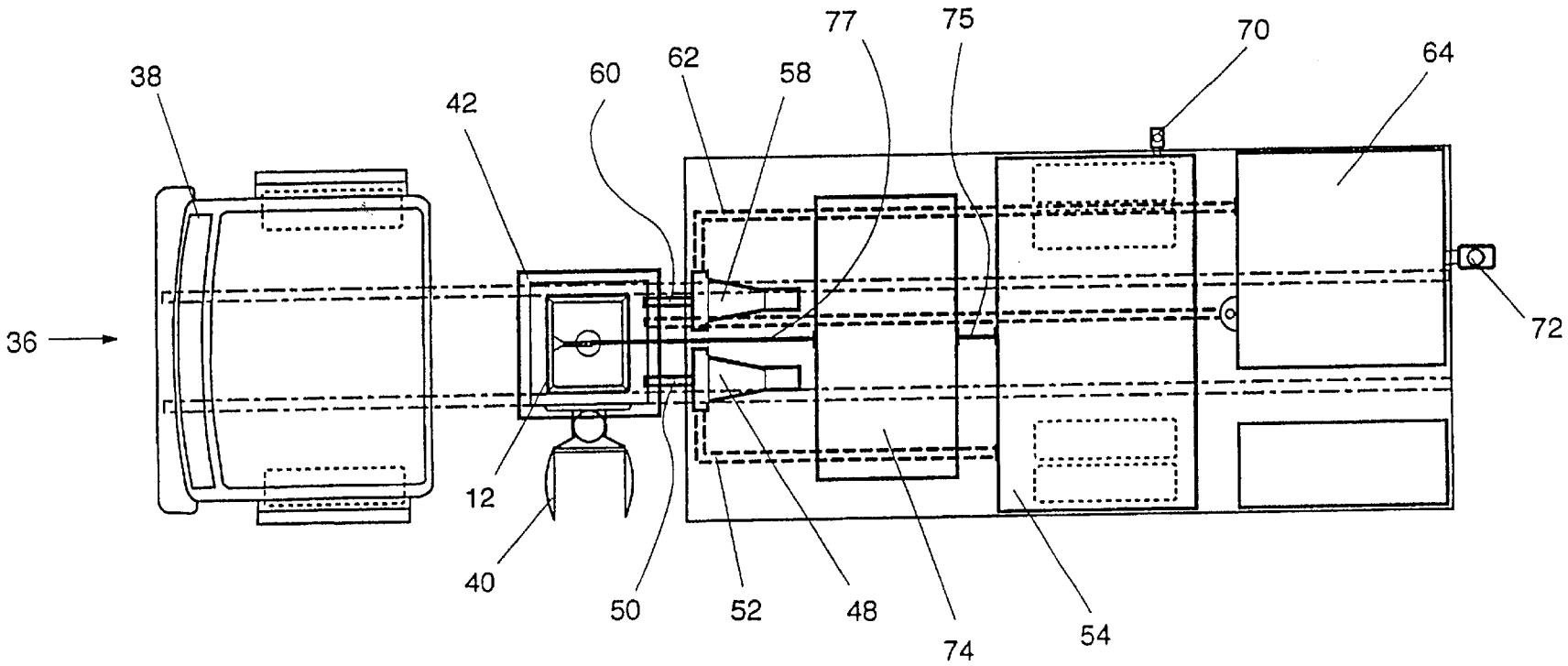
FIG. 2 is a plan view of a mobile cleaning system for a bin incorporating the apparatus shown in FIG. 1.
Figure 3:
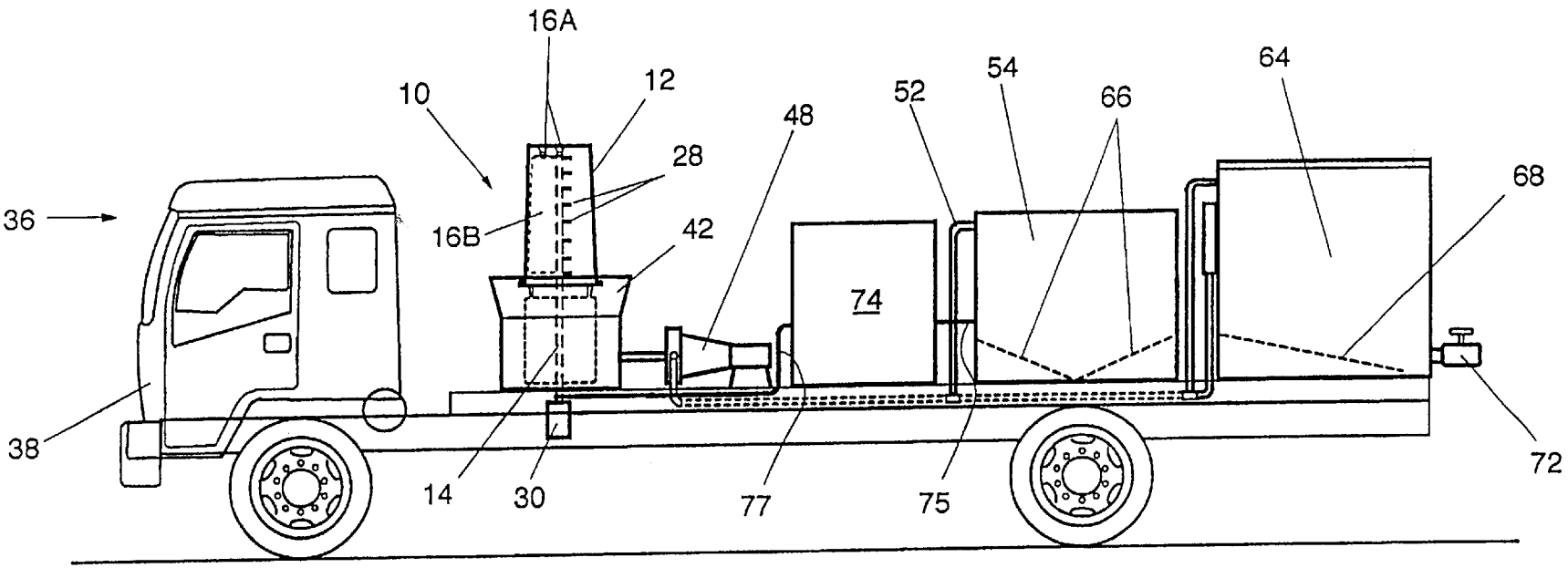
FIG. 3 is a side elevation of the cleaning system shown in FIG. 2.

The apparatus 10 can be incorporated into a mobile cleaning system 36 for bins shown in FIGS. 2 and 3. The system 36 includes: a vehicle in the form of a tray top truck 38; the apparatus 10 mounted on the truck 38; a bin manipulating arm or bin lifter 40 for gripping, lifting and inverting a bin 12; and, a catchment tank 42 mounted an the truck 38 and through which the stem 14 passes. When used, the bin lifter 40 grips, lifts and inverts the bin 12 and holds the bin 12 over both the stem 14 and the catchment tank 42 so that the cleaning fluid used in cleaning the bin and the debris washed from the bin fall into the catchment tank 42.

The bin lifter 40 is designed so that it holds the bin in an inverted position while cleaning takes place with the inside of the bottom wall 20 in contact with the brushes 16A and brushes 16B in contact with the inside of the side walls of the bin. A filter means in the form of a mesh screen 44 (shown mostly clearly in FIG. 1) extends diagonally across the catchment tank 42 to filter the cleaning fluid and debris failing from the bin 12. Typically the screen 44 will have a mesh spacing of less than one millimetre so that any solid of a greater size than that cannot pass therethrough. Basically, the screen 44 acts to separate the cleaning fluid from the solids. The cleaning fluid and any solid particle of a size less than that of a mesh size passes through the mesh 44 and can be drawn off through outlet 46 at the bottom of tank 42 to be recycled and reused in the cleaning process. To this end, the system 36 includes a pump 48 mounted on the truck 38 and having a suction line 50 connected with the outlet 46. A discharge line 52 of the pump leads to a water storage tank 54 that holds a supply of water for use in cleaning of the bins 12. Solid wastes which do not pass through the screen 44 collect in the tank 42 and can be removed via an outlet 56 in a tank 64. A second pump 58 mounted on the truck 38 has a suction line 60 coupled to the outlet 56 and a discharge line 62 leading to a solid waste storage tank 64 also mounted on the truck 38.

Both the tanks 54 and 64 are provided with inclined screen like bottom surfaces which act as filters to separate solid matter from the cleaning liquid. The screen like surfaces are shown as item 66 in the tank 54 and item 68 in tank 64. Thus, any water settling out of the solid waste stored in tank 64 passes through the screen 68 and can be returned to the water storage tank 54. Water for cleaning is drawn from tank 54 from a point below screen 66.

A valve 70 is provided in the side of tank 54 to allow filling and emptying of the tank 54. Similarly a valve 72 is provided on the side of tank 64 to allow extraction of the solid waste from that tank.

A WAIPLTNA™ system 74 is also mounted on the truck 38 to heat and pressurise the water from tank 54 to a pressure in the range of 70–200 kpa gauge pressure and a temperature of between 80–110° Celcius. Although it is believed that an ideal temperature and pressure combination of the water would be 100° Celcius at 250 psi. Water from the storage tank 54 passes via pipe 75 to the WAIFTNA™ system 74 and is then supplied via pipe 77 to the stem 14 for transfer to the inside of the bin 12.

It is envisaged that the mobile cleaning system 36 would be used in tandem with conventional garbage collection trucks so that after the bin has been emptied of refused the garbage truck the system 36 will follow to clean the bin.

Now that embodiments of the present invention have been described in detail, it will be apparent those skilled in the relevant arts and numerous modifications and variations may be made without departing from the basic inventive concepts. For example, the nozzles 28 can be removed and the stem 14 is to be provided with a series of holes so as to act like a manifold spraying cleaning fluid into the bin 12. Also, the brushes 16A and 16B can be demountably retained on the stem 14 or arm 18 to allow easy replacement or repair. Also other configurations of brushes can be used for example a spiral brush wound around the stem 14. If desired cleaning agents or deodorants may be added to the water used as the cleaning fluid although it is preferred that it be non foaming so as to not effect the operation of any pumps used to pumping the cleaning liquid. Also, the motor 30 can be driven by a hydraulic fluid rather than the cleaning fluid. Alternately, the stem 14 can be rotated by use of belts and pulleys or in any other conventional method.

All such modifications and variations are deemed to be within the scope of the present invention the nature of which is to be determined by the aforegoing description and the appended claims.

Although the invention has been described with respect to various embodiments, it should be realized this invention is also capable of a wide variety of further and other embodiments within the spirit and scope of the appended claims.

What is claimed is:

1. A mobile cleaning system for a bin including:

a self propelled vehicle;

a bin manipulation arm for gripping, lifting and inverting a bin;

an apparatus for cleaning a bin supported on said vehicle, the apparatus comprising a single elongate rotatable stem locatable at a fixed spatial position within a bin when the bin is held in an inverted state by said bin manipulation arm, said stem adapted to transfer cleaning liquid to the inside of the bin and supporting a brush means contacting the inside of the bottom of said bin and side wall of said bin in a manner so that in one complete revolution of the stem substantially the whole of the inside of the bottom and side wall are contacted by the brush means;

stationary spray means for spraying cleaning fluid onto an inside surface of a lid of said bin where the bin is in the inverted state;

a catchment tank supported on said vehicle in which said stem and stationary spray means are located for collecting said cleaning liquid;

whereby, in use, the bin manipulation arm grips, lifts and inverts the bin and holds said bin over said stem and the catchment tank and said stem is rotated and cleaning fluid supplied to said stem so that refuse is removed from the inside of the bin by a combination of the cleaning fluid and rotating brush means, and wherein said cleaning fluid and debris washed from said bin fall into said catchment tank.

2. A system according to claim 1 wherein said vehicle includes a hydraulic motor at a lower end of said stem for applying torque to rotate said stem, wherein said hydraulic motor is driven by said cleaning fluid.

3. A system according to claim 2 wherein said cleaning fluid is water delivered to said stem at a pressure in the range of 70–200 kpa and a temperature between 80–110° C.

* * * * *